US006641360B2

(12) United States Patent
Beeck et al.

(10) Patent No.: US 6,641,360 B2
(45) Date of Patent: Nov. 4, 2003

(54) DEVICE AND METHOD FOR COOLING A PLATFORM OF A TURBINE BLADE

(75) Inventors: Alexander Beeck, Orlando, FL (US); Stefan Florjancic, Mellingen (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 10/003,419

(22) Filed: Dec. 6, 2001

(65) Prior Publication Data

US 2002/0098078 A1 Jul. 25, 2002

(30) Foreign Application Priority Data

Dec. 22, 2000 (DE) ..... 100 64 265

(51) Int. Cl.[7] ..... F01D 5/18
(52) U.S. Cl. ..... 415/1; 415/115; 416/97 R
(58) Field of Search ..... 415/1, 115, 173.5, 415/173.4, 173.3, 173.6, 173.2, 173.1, 180; 416/97 R, 96 R, 191, 190

(56) References Cited

U.S. PATENT DOCUMENTS 5,387,085 A * 2/1995 Thomas, Jr, et al. ..... 416/97 R
5,460,486 A 10/1995 Evans et al.
5,482,435 A 1/1996 Dorris et al.
5,503,529 A * 4/1996 Anselmi et al. ..... 416/97 R
6,176,676 B1 * 1/2001 Ikeda et al. ..... 415/115
6,328,532 B1 * 12/2001 Hahnle ..... 416/97 R

FOREIGN PATENT DOCUMENTS

DE 196 01 819 8/1996
GB 1 514 613 6/1978

* cited by examiner

*Primary Examiner*—Edward K. Look
*Assistant Examiner*—J. M. McAleenan
(74) *Attorney, Agent, or Firm*—Burns, Doane, Swecker & Mathis, L.L.P.

(57) ABSTRACT

Described is a device and a method for cooling a platform of a turbine blade comprising a blade root, a vane with a leading and trailing edge, as well as a blade tip with a platform, through which platform extends radially, at least in part, at least one cooling channel that is connected with at least one outlet channel exiting via an outlet opening at the platform. The invention is characterized in that the outlet channel has, adjacent to the outlet opening, a longitudinal channel direction that extends, in projection, longitudinally to the turbine blade in an essentially co-parallel manner with respect to the flow direction of a local flow field of a mass flux relatively passing by the turbine blade, said flow field directly flowing over the exit opening.

11 Claims, 3 Drawing Sheets

DEVICE AND METHOD FOR COOLING A PLATFORM OF A TURBINE BLADE

FIELD OF INVENTION

The invention relates to a device and a method for cooling a platform of a turbine blade comprising a blade root, a blade surface with a leading and trailing edge, as well as a blade tip with a platform, through which platform extends radially, at least in part, at least one cooling channel that is connected with at least one outlet channel exiting via an outlet opening at the platform.

BACKGROUND OF THE INVENTION

Cooling problems of the previously mentioned type occur in particular in turbine blades used in gas turbine systems. In particular, in the individual gas turbine stages, the hot gases generated inside the combustor flow around the turbine blades. In order to prevent overheating of turbine blades in operation, the aspect of targeted cooling of gas turbine blades plays an important role in the design and construction of such systems. Usually, part of the air precompressed in the compressor stage is removed in a targeted manner for cooling purposes and is therefore removed from the further combustion process. Rather, the cooling air reaches the area of the turbine stages via cooling channel systems provided both in rotating as well as stationary system components in order to cool the system components directly exposed to the hot gases. In order to cool the rotating blades arranged in a plurality of rotating blade rows positioned axially behind each other, the rotating blades have radial cooling channels through which cooling air fed in from the rotor arrangement is guided longitudinally to the turbine blade surfaces, exits through cooling air openings provided accordingly on the rotating blade surface, and mixes with the hot gases.

In some cases, turbine blades have platforms or so-called shrouds on their radial side facing away from the rotor arrangement in order to minimize leakage flows that are able to form between the turbine blade tips and the stationary system components. In the same way, such platforms and shrouds help in effectively dampening vibrations that form along the turbine blades during the operation of the gas turbine.

For the cooling of such platforms, U.S. Pat. No. 5,482,435 describes a cooling channel system within a platform, through which cooling air is guided and in this way effectively helps to cool the platform. The cooling air passes through a central cooling channel oriented radially towards the turbine blade into the area of the platform where said cooling air is discharged to the outside via two partial channels. The partial cooling channels provided in the platform extend in such a way that the cooling air exiting from the platform is oriented almost vertically to the main flow direction of the hot gases flowing through the gas turbine. On the one hand, this has the result, however, that the flow behavior of the main flow is significantly irritated, so that the aerodynamic efficiency is reduced. On the other hand, the cooling air exiting from the platform is unable to contribute to any energy yielding or improved energy conversion inside the gas turbine.

SUMMARY OF THE INVENTION

The invention is based on the objective of further developing a device as well as a method for cooling a platform of a turbine blade in such a way that the main flow acting directly on the turbine blade is impaired as little as possible in order not to aggravate the aerodynamic conditions within the turbo-machine. Rather, the goal is to achieve, in addition to the previously mentioned effective cooling effect, an additional energy yield by means of the exit of the cooling air from the platform.

According to the invention, a device for cooling a platform of a turbine blade comprising a blade root, a blade surface with a leading and trailing edge, as well as a blade tip with a platform, through which platform extends radially, at least in part, at least one cooling channel that is connected with at least one outlet channel exiting via an outlet opening at the platform, is further developed in such a way that the outlet channel has, adjacent to the outlet opening, a longitudinal channel direction that extends, in projection, longitudinally to the turbine blade in an essentially co-parallel manner with respect to the flow direction of a local flow field of a mass flux relatively passing by the turbine blade, said flow field directly flowing over the exit opening.

In principle, the cooling device according to the invention can be used for all turbine blades provided with a platform. The advantages connected with the measure according to the invention are explained in more detail below in reference to the example of the turbine guide blade inside a gas turbine system. Naturally, it would also be possible to use the cooling device according to the invention with platforms of stationary guide blades. The measure according to the invention is not restricted to the use of turbine blades inside gas turbine stages of gas turbine systems, but can be used in all turbo-machines in which similar cooling problems occur, for example, inside compressors or similar turbo-machines.

The arrangement of the exit channel according to the invention inside the platform, through which the cooling air exits through an exit opening, is, according to the invention, oriented in such a way that the cooling air flowing from the platform preferably has the same flow direction with which the main flow of the hot gases flows around the turbine blade and therefore around the platform itself. If the exit opening of the outlet channel is provided on the platform top side radially facing away from the turbine blade surface, the cooling channel preferably extends at a slight angle in relation to the platform top side. Alternatively, the exit opening may be positioned on the closing edge of the platform facing away from the flow, so that the cooling air flowing out of the platform is oriented co-parallel to the hot gases flowing around the platform. The exit opening of the cooling channel is located on the platform preferably downstream in relation to the leading edge of the turbine blade so that it is ensured that a cooling channel section as long as possible extends inside the platform so that the most effective cooling effect can be achieved.

Cooling measures inside the platform, which platform, in the case of rotating turbine blades, is subject to high centrifugal forces because of its radial spacing with respect to the rotation axis, make an important contribution to positively influencing the creeping behavior of the blade material in the area of the platform, i.e., any buckling and deformation of material as a result of a softening of the material with simultaneous action of high centrifugal forces is reduced or eliminated with effective cooling measures. With the help of the cooling measure according to the invention inside the platform, a creeping of the material can be significantly reduced.

The main advantage associated with the cooling channel system inside the platform is, however, the additional energy yield that can be achieved with the targeted, co-parallel flow exit of the cooling air relative to the main flow that flows around the turbine blade. It was found, for example, that the cooling air flowing out of the cooling channel oriented according to the invention flows through the exit opening on the platform, contributes to a measurable energy yield that is the result of the cooperation of an additional impulse contribution for driving the turbine blade and a relatively negligible irritation or impairment of the main flow of the hot gases flowing around the turbine blade.

It is preferred that a plurality of correspondingly oriented cooling channels be positioned inside a platform, so that the previously described, advantageous effects with respect to cooling effect and additional energy contribution can be increased. Additional details with respect to possible exemplary embodiments can be found in detail in the following exemplary embodiments.

To produce the platform constructed according to the invention, a number of known techniques can be used to produce the cooling channel or a plurality of correspondingly oriented cooling channels into the platform. Especially suitable for this purpose are EDM processes (electro-discharge machining) and also conventional drilling techniques using laser beams, electrochemical processes, as well as water jet techniques.

Naturally, it is also possible to provide platforms of turbine blades at their respective turbine blade roots with correspondingly oriented cooling channels. Although the aspect of an additional energy yield plays only a minor role for platforms in the blade root area, the exiting cooling air, as a result of the corresponding exit openings, does not or does only insignificantly impair the main flow, even in the area of the blade roots.

BRIEF DESCRIPTION OF THE DRAWINGS

The invention is described below as an example, using exemplary embodiments in reference to the drawing without limiting the general idea of the invention. Hereby.

DETAILED DESCRIPTION OF THE PREFERRED EMBODIMENT

Figure 1:
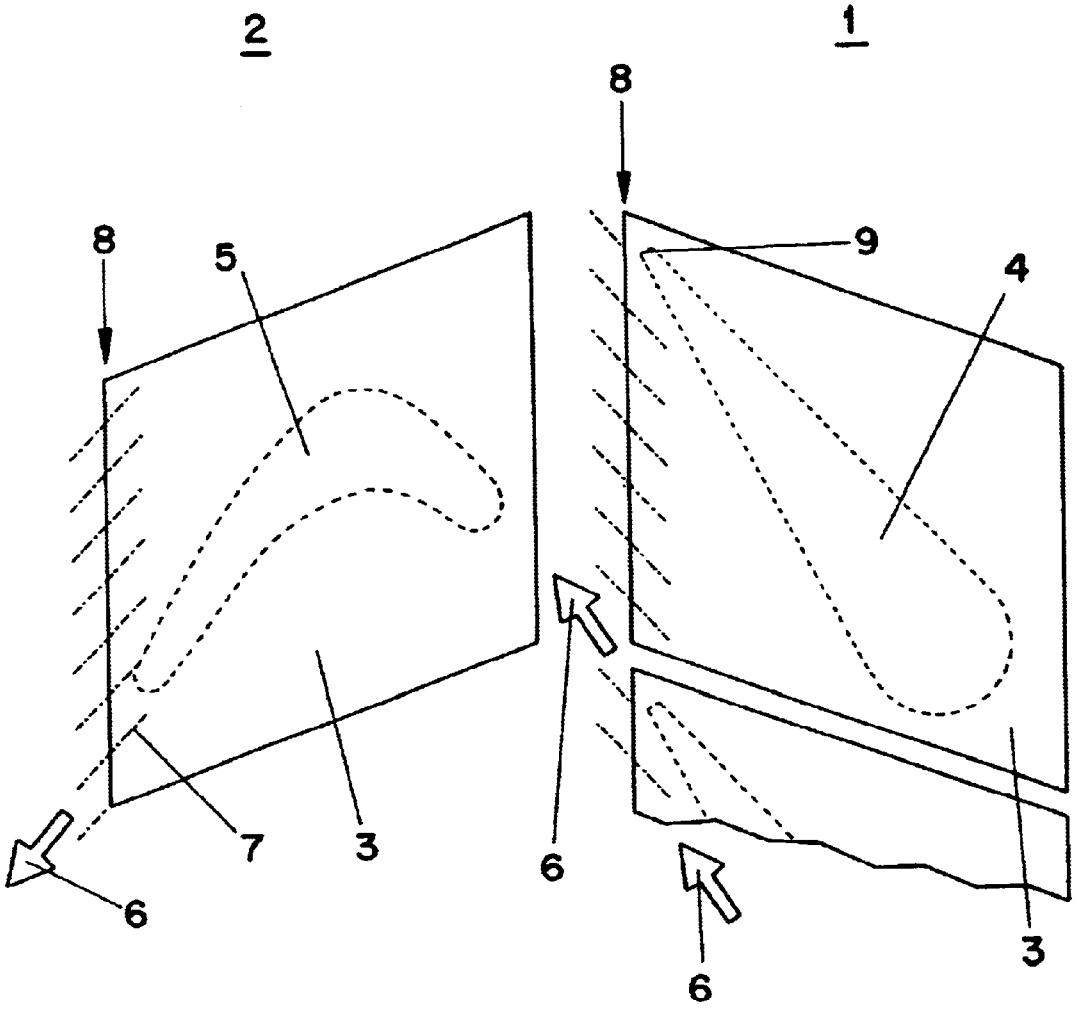
FIG. 1 shows a top view onto the axial arrangement of a rotating turbine blade positioned in a row of rotating turbines, as well as a corresponding turbine guide blade positioned correspondingly in an axially upstream position.

FIG. 1 shows a top view onto an axial arrangement, consisting of a guide blade row 1 and a rotating blade row 2 following in flow direction. In particular, the platforms 3 of a guide blade 4 as well as of a rotating blade 5 are shown, whereby the guide blade 4 or rotating blade 5 extends vertically, longitudinally to the drawing plane, facing away from the viewer. As a result of the corresponding angling of the guide or rotating blades relative to the main flow 6 that axially flows through the turbine blade arrangement, the main flow 6 is deflected by the turbine blade surfaces away from a purely axial direction. In this way the main flow 6, immediately after flowing through the guide blade row 1, is directed upwards in circumferential direction, whereas the main flow is deflected contrary to the rotating direction after flowing around the rotating blade row 2. The angle of the flow direction in relation to the axial direction is determined directly downstream from a turbine blade row essentially by the angle of the turbine blade surfaces relative to the main flow and the circumferential speed. For the cooling of the platforms 3, cooling channels 7 are arranged preferably in the area of the end edge 8 of the platforms 3 that is directed downstream, in such a way that the cooling air exits the cooling channels 7 parallel to the main flow 6. For this purpose, the longitudinal axes of the cooling channels 7 are arranged parallel to the turbine blade surface in the area directly upstream from the trailing edge 9.

Figure 2:
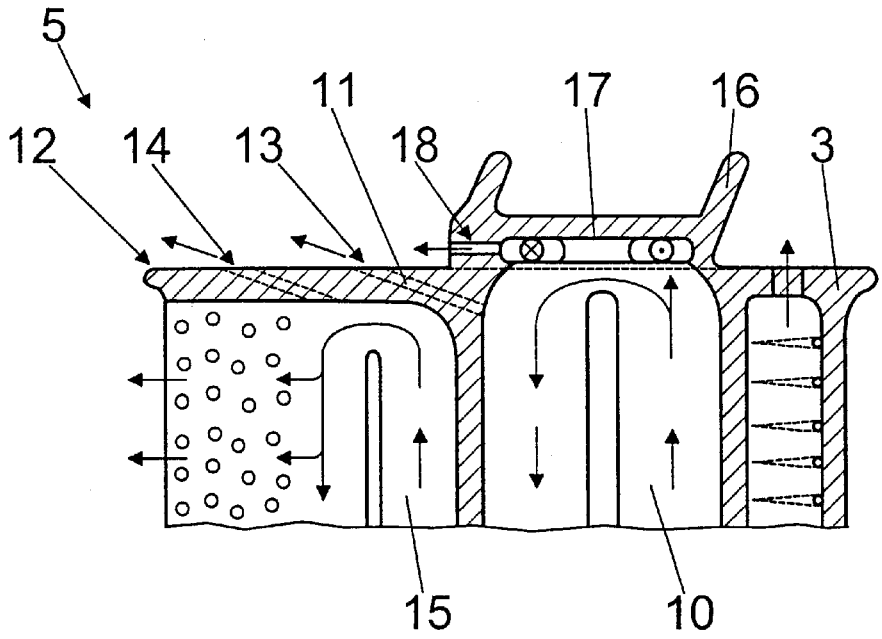
FIG. 2 shows a partial view through a radial longitudinal section through a turbine blade with platform.

FIG. 2 shows the top part of a longitudinal section through a turbine blade that is constructed, for example, as a rotating blade 5 and is provided in its top area with a platform 3. The rotating blade 5 is provided with a radially extending main cooling channel 10, in which cooling air is passed from the rotating blade root (not shown) into the area of the platform 3. A number of cooling channels 11 that extend at an angle to the platform top side 12 and in each case are provided with an exit opening 13 merge on one side into the main cooling channel 10. Cooling air that exits through the outlet channels 11 through the respective outlet opening 13 on the platform top side 3 is directed at a slight angle to the platform top side 12, but in the flow direction of the main flow 6. Other cooling channels 14 end via corresponding additional exit openings at the platform top side and are supplied via additional cooling air channels 15 provided in an appropriate manner with cooling air.

The platform 3 of the rotating blade 5 shown in FIG. 2 is provided with a typically constructed labyrinth seal 16, directly under which a cooling channel volume 17 is provided with an outlet 18 that is correspondingly directed downstream.

Figure 3:
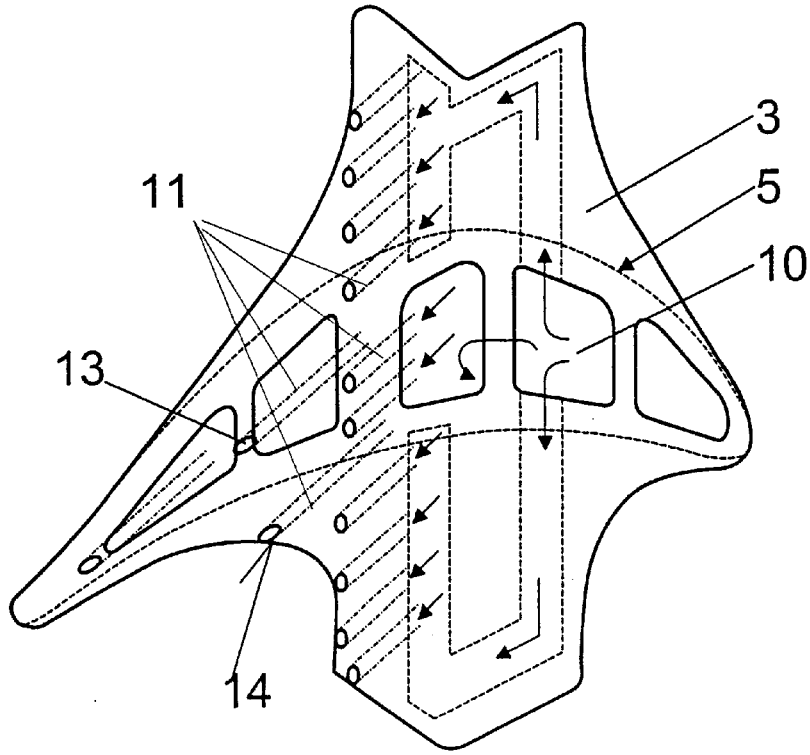
FIG. 3 shows a top view onto a platform in radial direction.
Figure 4:
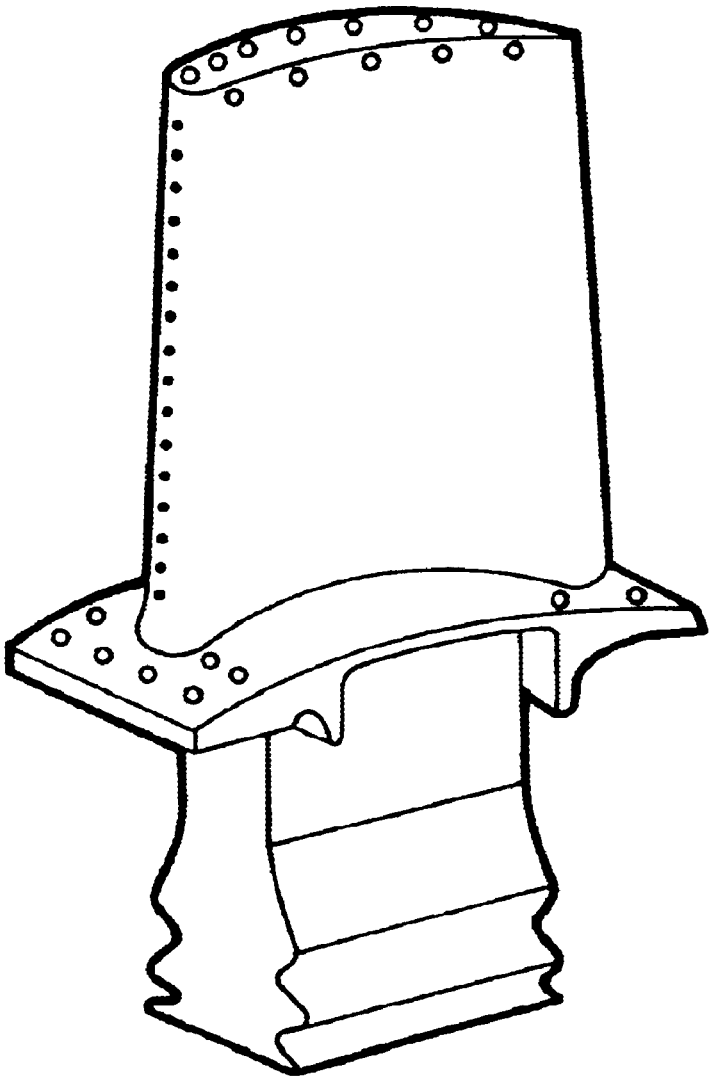

FIG. 3 shows a top view onto a platform 3, below which a rotating blade 5 extending in longitudinal direction is provided. The rotating blade 5 is provided, with various hollow channels extending longitudinally to the turbine blade, from which hollow channels cooling air exits from hollow channel 10 in the direction towards the platform. The hollow channel 10 that is constructed as a cooling channel is directly adjoined by a cooling air system, through which the individual cooling channels 13 and 14 are supplied with cooling air. The cooling air flows along the arrow direction shown for the individual channels and exits at the corresponding outlet openings 13, 14 on the top side 12 of the platform 3.

What is claimed is:

1. A device for cooling a platform of a turbine blade, the turbine blade comprising: a blade root, a blade leaf with a leading and trailing edge, a platform between the blade root and the blade leaf and/or a blade tip with a shroud, through which platform and/or shroud extends at least one cooling channel that is connected with at least one outlet channel exiting via an outlet opening at the platform, wherein the outlet channel has, a longitudinal channel direction that extends in an essentially parallel manner with respect to a flow direction of a local flow field of a mass flux relatively passing by the turbine blade.

2. The device according to claim 1, wherein the outlet opening is arranged in the area of said platform upstream to the trailing edge of said turbine blade.

3. The device according to claim 1, wherein a coolant is able to flow through the outlet channel, said coolant leaving the outlet opening in the flow direction to the local flow field.

4. The device according to claim 1, wherein the turbine blade is integrated in a turbo-machine through which the mass flux extends axially.

5. The device according to claim 1, wherein the outlet opening is arranged at or close to an end of said platform and/or said shroud facing away from the flow.

6. The device according to claim 1, wherein at said shroud are arranged two radially directed rip, where at least an outlet opening in the direction of the surrounding flow of the turbine blade is provided above the tip of the turbine blade and below the sealing rips.

7. The device according to claim 6, wherein a number of outlet openings in the direction of surrounding flow the turbine blade are arranged above the tip of the turbine blade and below the sealing rips.

8. The device according to claim 6, wherein a number of outlet openings in the direction of surrounding flow the turbine blade is at a slight angle to the shroud.

9. The device according to claim 1, wherein the turbine blade is a guide blade inside a gas turbine.

10. The device according to claim 2, wherein a number of outlet openings in the direction of surrounding flow the turbine blade are arranged in the area of said platform upstream of the trailing edge of said turbine blade.

11. A device for cooling a platform of a turbine blade, the turbine blade comprising:

a blade root;

a blade leaf with a leading and trailing edge;

a platform between the blade root and the blade leaf and/or a blade tip with a shroud, through which platform and/or shroud extends;

at least one cooling channel is connected with at least one outlet channel exiting via an outlet opening at the platform;

wherein the outlet channel has, a longitudinal channel direction that extends, in an essentially parallel manner with respect to a flow direction of a local flow field of a mass flux passing by the turbine blade.

* * * * *